US006693375B1

(12) United States Patent
Maruyama

(10) Patent No.: US 6,693,375 B1
(45) Date of Patent: Feb. 17, 2004

(54) ELECTRON EMITTING DEVICE, ELECTRON SOURCE, IMAGE FORMING APPARATUS, AND METHOD FOR MANUFACTURING THEM

(75) Inventor: Tomoko Maruyama, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/505,629

(22) Filed: Feb. 16, 2000

(30) Foreign Application Priority Data

Feb. 17, 1999 (JP) ..... 11-038956
Feb. 14, 2000 (JP) ..... 2000-035166

(51) Int. Cl.[7] ..... H01J 1/62
(52) U.S. Cl. ..... 313/495; 313/310
(58) Field of Search ..... 313/306, 307, 313/309, 311, 346 R, 351, 495, 310, 336, 496; 445/24, 25, 50, 51

(56) References Cited

U.S. PATENT DOCUMENTS 5,066,883 A 11/1991 Yoshioka et al. ..... 313/309
5,861,227 A 1/1999 Ikeda et al. ..... 430/31

FOREIGN PATENT DOCUMENTS

JP 06-012997 1/1994
JP 08-162002 6/1996

*Primary Examiner*—Nimeshkumar D. Patel
*Assistant Examiner*—Joseph Williams
(74) *Attorney, Agent, or Firm*—Fitzpatrick, Cella, Harper & Scinto

(57) ABSTRACT

An object of the present invention is to provide an electron emitting device, an electron source having a plurality of the electron emitting devices, an image forming apparatus constituted by using the electron source, and a method for manufacturing them.

An electron emitting device includes a conductive film which consists of a metal alloy and has an electron emitting section between a pair of device electrodes. An electron source includes a plurality of the electron emitting devices on a substrate. An image forming apparatus includes the electron source and an image forming member for forming an image by irradiation of an electron ray from the electron source.

9 Claims, 11 Drawing Sheets

ELECTRON EMITTING DEVICE, ELECTRON SOURCE, IMAGE FORMING APPARATUS, AND METHOD FOR MANUFACTURING THEM

BACKGROUND OF THE INVENTION

1. Field of the Invention

The present invention relates to an electron emitting device, an electron source having a plurality of the electron emitting devices, an image forming apparatus such as a display device or an exposure device constituted by using the electron device, and a method for manufacturing them.

2. Related Background Art

An electron emitting device, e.g., a surface conduction electron emitting device utilizes a phenomenon such that an electric current is caused to flow through a conductive thin film formed on an insulating substrate in parallel to the film surface to produce the electron emission.

As a typical structural example of the surface conduction electron emitting device, there is one having a structure in which an electron emitting section is formed on a conductive thin film such as a metal oxide communicating between a pair of device electrodes provided on an insulating substrate by previously performing an electric process called forming. The forming is a process by which a voltage is usually applied to the both ends of the conductive thin film and the conductive thin film is locally fractured, deformed or transformed to change the structure so that an electron emitting section having an electrically high resistance is formed. The electron is emitted in the vicinity of a crack generated in the electron emitting section by applying a voltage to the conductive thin film to which the electron emitting section is formed to cause a flow of an electric current.

Since the surface conduction electron emitting device has a simple structure and can be easily manufactured, a plurality of the surface conduction electron emitting devices can be advantageously arranged and formed in a large area. Therefore, various applications for exploiting this characteristic have been studied. For example, there is an application to a charged beam source or an image forming apparatus such as a display device.

In particular, the display device can be a planar display device similar to a display device using a liquid crystal, and there is proposed a display device in which an electron source having a plurality of the surface conduction electron emitting devices arranged therein is combined with a fluorescent material for emitting a visible light ray by irradiation of an electron ray from the electron source as a spontaneous light type display device requiring no back light (specification of U.S. Pat. No. 5,066,883).

In regard to forming when a plurality of the devices are arranged to obtain the electron source and the image forming apparatus, there is proposed a hydrogen assist forming method by which a plurality of the devices on the same wiring are simultaneously and uniformly formed by flowing an electric current to the conductive thin film as a metal oxide film while inducing hydrogen (Japanese Patent Application Laid-Open No. 6-12997).

Further, there is proposed a forming method using a local reaction in which opposed device electrodes are made of different electrode materials and the electron emitting section is formed to an edge of one electrode of the conductive thin film extending between the device electrodes by using a material which reacts to the electrode material on the edge of one electrode below a given temperature (Japanese Patent Application Laid-Open No. 8-162002). In the embodiment of this publication, Pd and PdO are used for the conductive thin film; Au is used for the electrode which reacts to the conductive thin film; and Pt and Ni are used for the electrode which does not react.

In case of the surface conduction electron emitting device in which the electron emitting section is formed to a part of the conductive thin film by the above-described forming process, the power required for forming or an aspect and others of the electron emitting section largely vary depending on the film quality of the conductive thin film.

As to the forming power, in case of the electron source in which a plurality of surface conduction electron emitting devices are arranged and formed, a large electric current required for forming one device makes it difficult to simultaneously conduct electricity to a plurality of the surface conduction electron emitting devices to perform forming, and the large power needs an expensive forming apparatus and an increase in current capacity for the wiring, thereby requiring use of an expensive wiring material having the high electrical conductivity.

In addition, when manufacturing the above-described display device by combining the electron source in which a large number of the surface conduction electron emitting devices are arranged and formed with an image forming material and others, a high-temperature heating process must be carried out for multiple times in case of the display device using glass in particular. When such a high-temperature heating process is performed, the electric property of the conductive thin film may be changed and a desired voltage can not be applied to the electron emitting section in some cases.

More specifically, although a change in morphology during the above-described high-temperature heating process and a change in shape of a crack generated due to concentration of an electric current to the electron emitting section formed by the forming can be suppressed by using the conductive thin film having a high fusing point, employment of a metal having a high fusing point requires a large power during the forming as described above. On the other hand, the above-mentioned changes can be suppressed by using the metal oxide film for increasing a fusing point, but an electric current effectively flowing through the electron emitting section disadvantageously becomes small because the electric resistivity becomes incommensurably larger than that in case of using a metal.

Incidentally, according to the forming method using the local reaction proposed in Japanese Patent Application Laid-Open No. 8-162002, improvement of the device uniformity by controlling a shape of the electron emitting section and reduction in the forming current can be achieved, but the heat resisting stability after forming is not satisfactory.

SUMMARY OF THE INVENTION

It is an object of the present invention to provide an electron emitting device having a stable electron emitting characteristic and an electron source.

It is another object of the present invention to provide an electron emitting device having a stable electron emitting characteristic to heat in particular and an electron source.

It is still another object of the present invention to provide an image forming apparatus in which changes in image to be formed with time are reduced.

It is yet another object of the present invention to provide a method for manufacturing an electron emitting device, an electron source and an image forming apparatus, by which the electric power in the electric process is reduced as much as possible in the manufacturing process.

It is a further object of the present invention to provide a method for manufacturing an electron emitting device, an electron source and an image forming apparatus superior in characteristic reproducibility.

The present invention provides an electron emitting device provided with a conductive film having an electron emitting section between a pair of device electrodes, wherein the conductive film is made of a metal alloy.

Further, the present invention provides an electron emitting device provided with a pair of conductive films which are connected to each of a pair of device electrodes between the pair of device electrodes and arranged with a first gap therebetween, wherein the pair of conductive films are made of a metal alloy.

Furthermore, the electron emitting device is also characterized in that the metal alloy is an alloy composed of Pd and Pt or the conductive film contains a carbon film.

In addition, the present invention provides an electron emitting device provided with a conductive film having an electron emitting section between a pair of device electrodes, wherein the conductive film includes at least two types of all solid soluble metal.

Moreover, the present invention provides an electron emitting device provided with a pair of conductive films which are connected to each of a pair of device electrodes between the pair of device electrodes and arranged with a first gap therebetween, wherein the pair of conductive films include at least two types of all solid soluble metal.

Further, the electron emitting device is characterized in that the two types of metal are Pd and Pt or that a carbon film so arranged as to form a second gap narrower than the first gap is provided on the pair of conductive films and in the first gap.

Furthermore, the present invention provides an electron source having a plurality of electron emitting devices, wherein the electron emitting device is any one of the above-described electron emitting devices.

In addition, the present invention provides an electron source having a plurality of electron emitting devices matrix-wired on a substrate, wherein the electron emitting device is any one of the above-mentioned electron emitting devices.

Additionally, the present invention provides an image forming apparatus comprising an electron source and an image forming member for forming an image by irradiation of an electron ray from the electron source, wherein the electron source is any one of the above-described electron sources.

Moreover, the present invention provides a method for manufacturing an electron emitting device provided with a conductive film having an electron emitting section between a pair of device electrodes, the method for manufacturing an electron device comprising the steps of: forming the conductive film having at least two types of metal elements capable of forming a metal alloy; and applying a voltage to the conductive film.

Further, the present invention provides a method for manufacturing an electron emitting device provided with a conductive film having an electron emitting section between a pair of device electrodes, the method for manufacturing an electron emitting device comprising the steps of: forming the conductive film having at least two types of all solid soluble metal elements; and applying a voltage to the conductive film.

Furthermore, the above-described method for manufacturing an electron emitting device is characterized in that one of the two types of metal elements exists as a metal oxide and the other exists as a metal in the conductive film and that application of a voltage to the conductive film is carried out in reduced atmosphere or that the two types of metal elements are Pd and Pt or that an atomisity composition of the Pt is not more than 50 atomic %.

In addition, the present invention provides a method for manufacturing an electron source having a plurality of electron emitting devices, wherein the electron emitting device is manufactured by any one of the above-described methods.

Additionally, the present invention provides a method for manufacturing an electron source having a plurality of electron emitting devices matrix-wired on a substrate, wherein the electron emitting device is manufactured by any one of the above-mentioned methods.

Moreover, the present invention provides a method for manufacturing an image forming apparatus comprising an electron source and an image forming member for forming an image by irradiation of an electron ray from the electron source, wherein the electron source is manufactured by any one of the above-mentioned methods.

DETAILED DESCRIPTION OF THE PREFERRED EMBODIMENTS

Preferred embodiments according to the present invention will now be described hereinafter.

A first embodiment of an electron emitting device according to the present invention will be first explained hereunder.

Figure 1A:
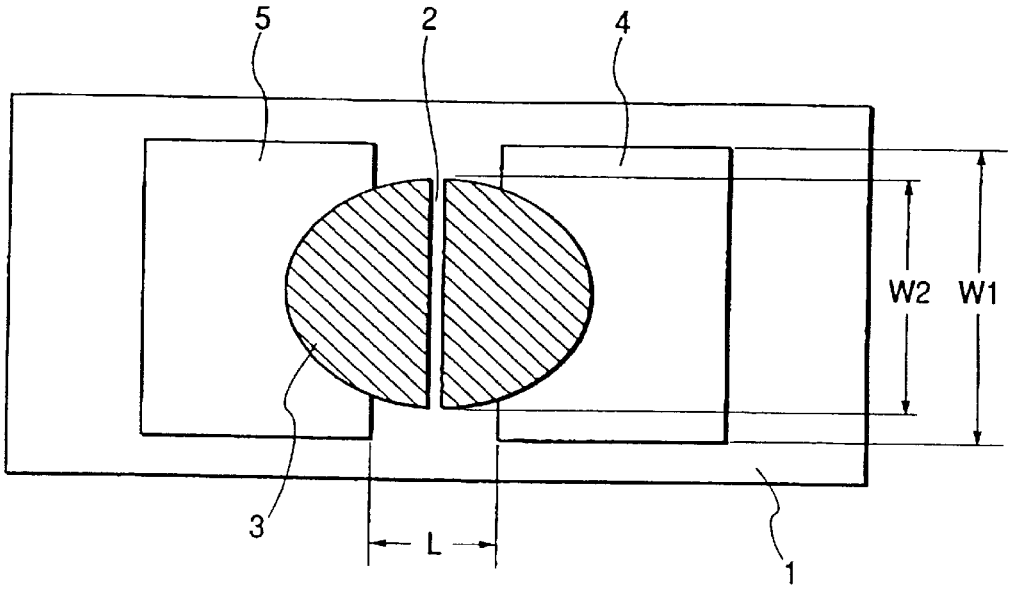
FIGS. 1A and 1B are block diagrams showing a surface conduction electron emitting device according to a first embodiment of the present invention.
Figure 1B:
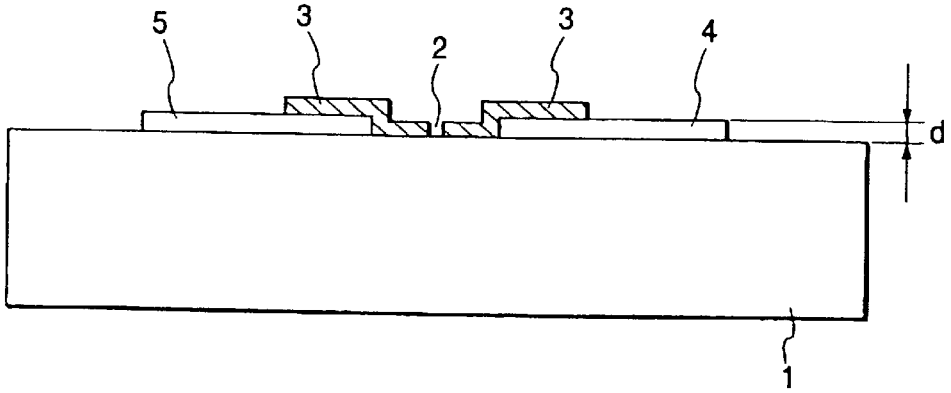

Referring to FIGS. 1A and 1B, a basic structure of the electron emitting device according to the first embodiment will be described. FIG. 1A is a top plan view and FIG. 1B is a cross-sectional view, in which reference numeral 1 denotes a substrate; 3, a conductive film; 2, a first gap; and 4 and 5, device electrodes.

The electron emitting device of this embodiment is referred to as a surface conduction electron emitting device and, as shown in FIGS. 1A and 1B, the electron emitting device comprises a pair of device electrodes 4 and 5 and a pair of conductive films 3 which are connected to each of the pair of device electrodes 4 and 5 between the pair of device electrodes 4 and 5 and arranged with a first gap 2 therebetween.

Here, as the substrate 1, there are often used, for example, quartz glass, glass in which a content of an impurity such as Na is reduced, blue plate glass, a lamination in which $SiO_2$ are laminated on the blue plate glass by a spattering method and the like, ceramics such as alumina, and others.

A general conductive material is used as a material of the opposed device electrodes 4 and 5 and, for example, a metal or a metal alloy such as Ni, Cr, Au, Mo, W, Pt, Ti, Al, Cu, a print conductor constituted by a metal or a metal oxide such as Pd, Ag, Au, $RuO_2$, Pd—Ag and glass and the like, a transparent conductor such as $In_2O_3$—$SnO_2$, and a semiconductor material such as a polysilicon are appropriately selected.

A distance between the device electrodes L, a length of the device electrode W1, a shape of the conductive thin film 3 and others are adequately designed in accordance with an applied mode and others.

The distance between the device electrodes L may be preferably set to several hundred Å to several hundred $\mu$m, or more preferably, several $\mu$m to several hundred $\mu$m depending on a voltage applied between the device electrodes 4 and 5 and the like.

Taking a resistivity or an electric emitting characteristic of the electrode into account, the length of the device electrode W1 may be preferably several $\mu$m to several hundred $\mu$m, and a thickness of the device electrode d may be several hundred Å to several $\mu$m.

The conductive film 3 is made of at least two types of metal. (1) A plurality of the metal materials for forming the conductive film 3 do not form a specific compound and are solid metals which tend to be compatible or preferably all solid soluble (all compatible) metals. In other words, the conductive film 3 constituted by the above-mentioned metals is a conductive film made of a metal alloy. (2) The gap 2 of the conductive film 3 is not easily changed in shape due to local concentration of an electric current during application of a drive voltage, namely, a voltage effectively applied to the gap 2 is not preferably lowered even if the conductive film 3 is exposed to a high temperature. In addition, it is preferable that the morphology of the film in the vicinity of the gap 2 is not generated. That is, the metal material is preferably a metal material having a high fusing point. (3) At least one type of metal in the above-described metal materials is a metal appropriate for the forming in the reduced gas atmosphere (for example, a hydrogen assist forming) carried out for reducing a later-described forming power, or more preferably an easy-oxidation-easy-reduction metal which can be readily oxidized in the atmosphere and reduced in the hydrogen. (4) The above-mentioned metal materials are preferably those for forming a stable complex ion for forming an ink solution suitable for formation of the conductive film requiring no photolithography process in a later-described ink jet mode.

When arbitrary two types of metal are only mixed, the conductive film 3 can not necessarily become uniform microscopically. In particular, the vicinity of the gap 2 is exposed to a high temperature during driving, and the metal particle portion having a low fusing point is fused to cause a morphological change due to agglomeration. This causes deformation of the conductive film in the vicinity of the gap 2 and locally lowers a voltage effectively applied to the gap 2, thereby causing reduction in brightness. Further, although not so high as the temperature of the gap 2, a change in quality such as a morphological change of the film occurs even in an area relatively apart from the gap 2 during the heating process and the sealing process in particular in production of the electron source substrate and the image forming apparatus, and the conductivity is thereby lowered, which results in reduction in the effective voltage to the gap 2 to decrease the brightness. In order to prevent such a microscopic change in film due to heat, it is preferable that the conductive film 3 is constituted by metal materials satisfying at least the condition (1). Further, since the microscopic change in film is prominent when the conductive film 3 is a particulate film, it is effective for the stability of the conductive film 3 that the conductive film 3 is constituted by metal materials satisfying at least the above-described condition (1). Specifically, preferable combinations of the two types of metal are Pd—Pt, Au—Pd, Ag—Pd, Cu—Rh, Cu—Pd, Cu—Pt, Cu—Au, Ni—Rh, Ni—Au, Ni—Pt, Co—Rh, Co—Ir, Cu—Ni, Mo—Ta, W—Ta, Ti—Ta, Nb—Ta, Mo—Ti, Cr—W, Cr—Mo and others, and the combination of Pd—Pt is very preferable.

In regard to a material for satisfying the fourth condition, in order to form a solution with the above-described metal materials used as a stable complex ion for the simple and easy device film forming process employing the ink jet mode, elements of the platinum group can be very preferably used. That is, most of the elements of the platinum group have multiple oxidation numbers and do not generate a simple cation, and it is famous that most of them exist as a complex except a few kinds of aqua ion.

A film thickness of the conductive thin film 3 is appropriately set by taking an electric resistivity between the device elements 4 and 5, the later-described forming condition and others into consideration. The film thickness of the conductive thin film 3 is preferably 10 Å to 1000 Å, and more preferably 100 Å to 300 Å.

The gap 2 has a crack formed to the conductive film 3 by, e.g., the later-described forming process, and the electron is emitted in the vicinity of this crack by applying a voltage between the device electrodes 4 and 5.

A second embodiment of the electron emitting device according to the present invention will now be described hereinafter.

Figure 2A:
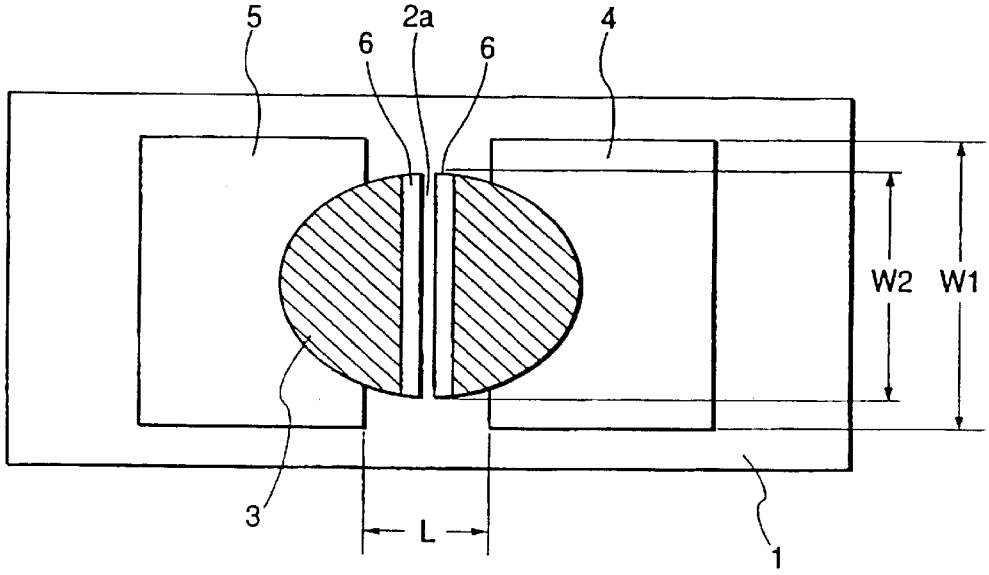
FIGS. 2A and 2B are block diagrams showing a surface conduction electron emitting device according to a second embodiment of the present invention.

A basic structure of the electron emitting device according to the second embodiment will be explained with reference to FIGS. 2A and 2B. FIG. 2A is a top plan view and FIG. 2B is a cross-sectional view, in which reference numeral 1 denotes a substrate; 3, a conductive film; 2, a first gap; 2*a*, a second gap; 4 and 5, device electrodes; and 6, a carbon film.

Figure 2B:
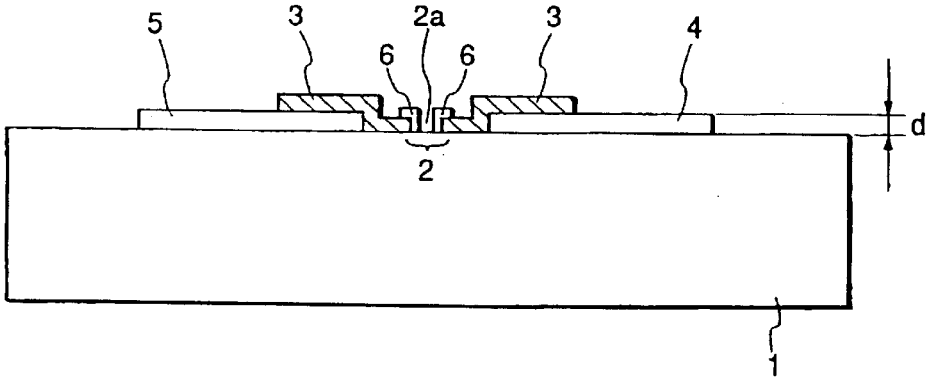

The electron emitting device of this embodiment is also referred to as a surface conduction electron emitting device and, as shown in FIGS. 2A and 2B, the electron emitting device comprises: a pair of device electrodes 4 and 5; a pair of conductive films 3 which are connected to each of the pair of device electrodes 4 and 5 between the pair of device electrodes 4 and 5 with a first gap 2; and a carbon film 6 provided on the pair of conductive films 3 and in the first gap 2 so as to form a second gap 2*a* narrower than the first gap 2.

Here, the substrate 1, the device electrodes 4 and 5 and the conductive films 3 of the electron emitting device of this embodiment shown in FIGS. 2A and 2B are the same as those in the first embodiment described above with reference to FIGS. 1A and 1B. Additionally, in the electron emitting device of this embodiment shown in FIGS. 2A and 2B, the carbon film 6 is, for example, a film formed by a later-described activating process, and preferably a film composed of graphite (which indicates both monocrystal and polycrystal) and amorphous carbon (which indicates amorphous carbon and a mixture of the amorphous carbon and polycrystal graphite). Further, the film thickness is preferably not more than 500 Å, and more preferably not more than 300 Å.

Taking the surface conduction electron emitting device having the structure illustrated in FIGS. 1, 2A and 2B as an example, a method for manufacturing the surface conduction electron emitting device of this embodiment described above will be explained based on a manufacturing process chart of FIGS. 3A to 3D.

Figure 3A:
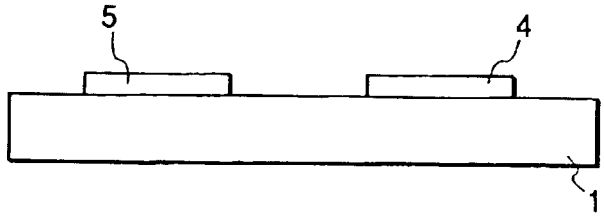
FIGS. 3A, 3B, 3C and 3D are views for explaining an example of a method for manufacturing the surface conduction electron emitting device depicted in FIGS. 1 and 2.

1) After sufficiently cleaning the substrate 1 by using a cleaning material, pure water and an organic solvent, the device electrode material is deposited by the vacuum evaporation method, the spattering method and the like, and the device electrodes 4 and 5 are then formed on the surface of the substrate 1 by the photolithography technique or the printing method (FIG. 3A).

2) The conductive film 3 is formed on the substrate 1 having the device electrodes 4 and 5 provided thereon by the spattering method, the CVD method, the electron beam heat evaporation method, or a method for applying the organic metal compound to be heated and baked and the like. The patterning is performed by lift off, etching and the like to form the conductive film 3 having a desired pattern.

The organic metal solution cited herein is an organic compound solution containing the above-described metals constituting the conductive film 3 as a metal complex, and one whose viscosity is adjusted by a solvent for obtaining a desired film thickness is used.

It is to be noted that the process using the photolithography technique can be very simplified by performing the process for patterning the conductive film 3 by using the ink jet method. The conductive film 3 is formed by using, for example, a method by which heating and baking are carried out after imparting a dot film between the device electrodes 4 and 5 by extruding droplets by the ink jet method. The ink described above represents the organic metal solution containing the metal complex ion, and one whose viscosity is adjusted by a solvent is used so as to obtain a desired film thickness and a desired dot diameter by the ink jet method.

It is to be noted that the conductive film 3 formed in this process is a conductive film containing two or more kinds of metal elements which are solid and tend to be compatible to each other or more preferably metal elements which are all solid soluble (all compatible) to each other. Further, one of the two kinds of metal elements exists in the conductive film as a metal whilst the other exists in the conductive film as a metal oxide, and the two kinds of metal elements are alloyed by the forming process in the later-described reduced gas atmosphere (for example, hydrogen gas).

That is, the later-described hydrogen assist forming is an effective technique for reducing the forming power. When the conductive film 3 is to be subjected to the hydrogen assist forming, since the conductive film 3 involves a change in bonding such as oxidation and reduction, the continuity for bonding the film is hard to be maintained, and generation of a discontinuous portion in the metal bonding of the conductive film, i.e., a bonding defective part due to the oxidation and reduction can readily cause reduction in conductivity of the conductive film. Further, when cohesion of the conductive film is involved at a high temperature, such reduction in conductivity of the conductive film is further encouraged. Reduction in conductivity due to the defection in bonding or the cohesion becomes prominent when the conductive film is a particulate film.

Figure 3B:
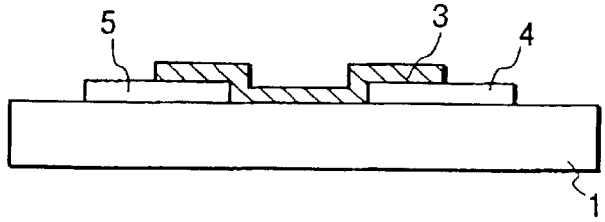
Figure 3C:
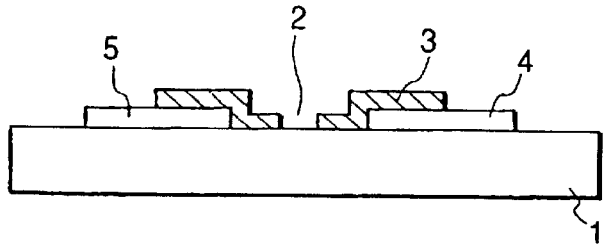

3) An electric process called forming is then applied to the conductive film 3. When an electric current is applied between the device electrodes 4 and 5 by a non-illustrated power supply, a crack is generated to the conductive film 3 to form the gap 2 (FIG. 3C).

Incidentally, when producing an electron source in which a plurality of electron emitting devices are arranged or an image display apparatus, a plurality of the conductive films 3-electrically connected to the wiring must be simultaneously formed and, in such a case, the hydrogen assist forming for applying electricity to the conductive film 3 in the reduced gas atmosphere is preferably used as an excellent method for reducing the forming power. The effect for suppressing the forming power using the hydrogen assist is efficient in principle when there is a difference in voltage between the electric process applied to the conductive film 3 by the hydrogen assist and the electric process using no hydrogen assist.

Figure 4A:
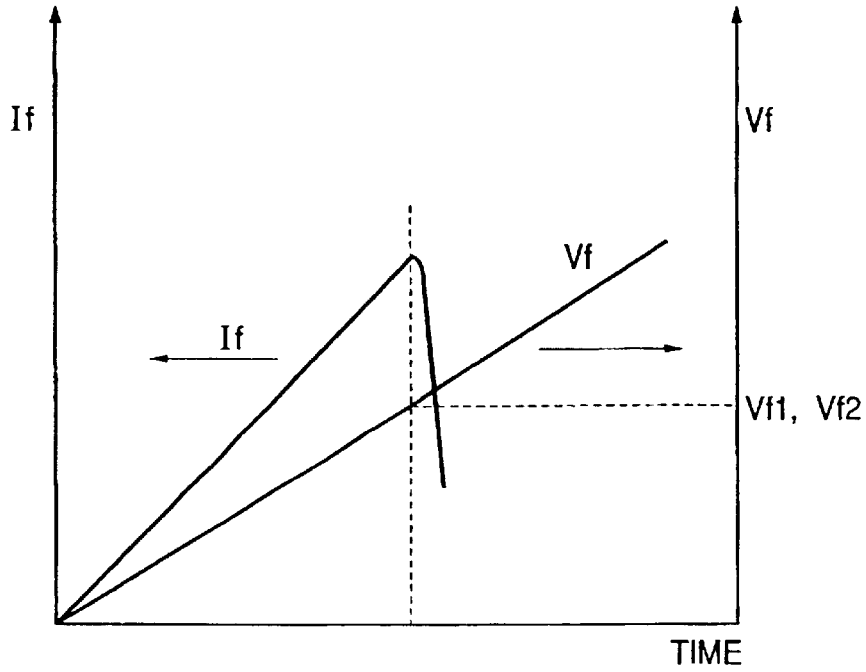
FIGS. 4A and 4B are type drawings showing a conductive thin film composition dependency of a forming voltage of the surface conduction electron emitting device according to the present invention.
Figure 4B:
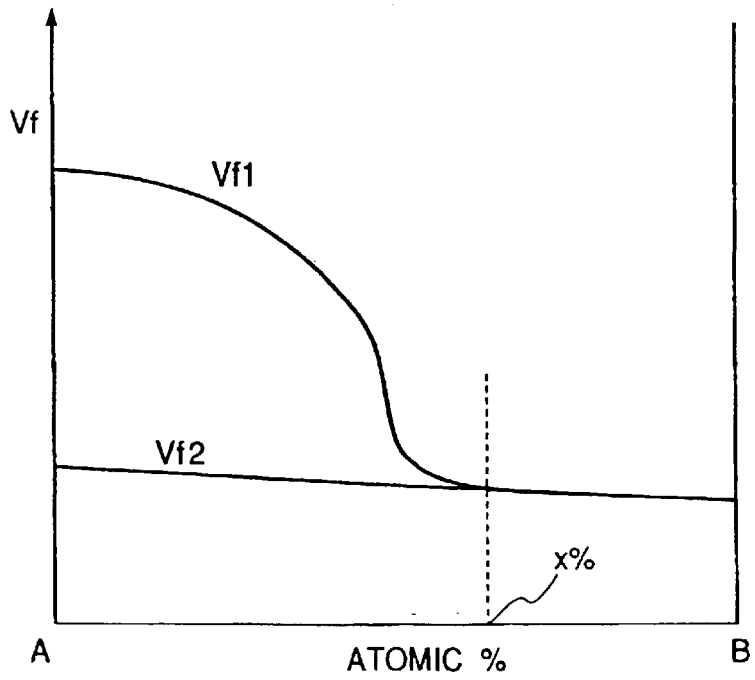

When the conductive film 3 contains the two kinds of metal elements as described above and at least one of the metals can reduce the forming power by the hydrogen assist in the electric process, the hydrogen assist forming can be preferably used. Assuming that the two types of metal elements constituting the conductive film 3 are represented as A and B respectively, FIGS. 4A and 4B show the relationship between the mixture composition of the two metal elements A and B and a forming voltage. Here, the metal element A is a hard-oxidation metal element which exists in the conductive film 3 as a metal and the metal element B is an easy-oxidation-easy-reductlon metal which exists in the conductive film 3 as a metal oxide. The mixture composition of the metal elements A and B is changed to prepare a device to which the conductive films 3 are formed respectively; the device is set in a later-described vacuum equipment; a voltage Vf is applied between the device electrodes 4 and 5 after evacuation; a value of Vf is gradually increased; and a value of Vf1 is obtained on the occasion when a device current If flowing through the conductive film 3 is reduced. The mixture composition of the metal elements A and B is changed to prepare another device to which the conductive films 3 are formed; the device is set in the later-described vacuum equipment; reduced gas (for example, 2% of hydrogen and 98% of nitrogen) is led in after evacuation; reduction is performed after a long interval of time and the reduced gas is then exhausted again; the voltage Vf is applied between the device electrodes 4 and 5; a value of Vf is gradually increased; and a value of Vf2 is obtained on the occasion when the device current If flowing through the conductive film 3 is lowered (FIG. 3A). In a range of not more than x% of the composition of A where a difference is generated between Vf1 and Vf2 in the mixture composition of the metal elements A and B, the forming adopting the hydrogen assist is preferably used (FIG. 3B).

Here, when the two types of metal form a complete substitutional alloy, the composition x of the metal element A which is effective for suppressing the forming power during the hydrogen assist forming can be preferably not more than 50 atomic % in principle. That is, the composition by which the metals are not bonded to each other to be combined with oxygen can be considered as A:B=1:1. Even if a number of devices is very small, when a plurality of devices are arranged in series to be simultaneously formed, the composition is effective for suppressing the forming power. As the composition approximate 50 atomic %, the effect for suppressing the forming power is gradually reduced, and the composition of the hard-oxidation metal element A is preferably approximately 3 atomic % to 45 atomic % as a practical range.

Incidentally, as a specific combination of the two types of metal elements, there are Pd—Pt, Au—Pd, Cu—Rh, Cu—Pd, Cu—Pt, Cu—Au, Ni—Rh, Ni—Au, Ni—Pt, Co—Rh, Co—Ir, Cu—Ni, Mo—Ta, Ti—Ta, Nb—Ta, Mo—Ti, Cr—W, Cr—Mo and others, and the combination of Pd—Pt is most preferable.

Figure 5A:
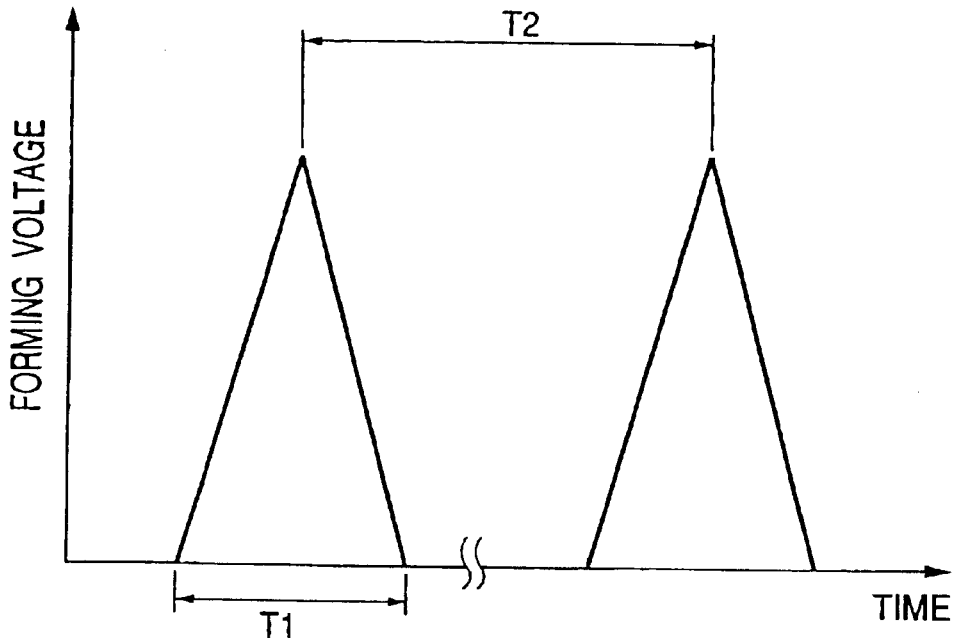
FIGS. 5A and 5B are views for showing an example of a voltage waveform used for a forming process.
Figure 5B:
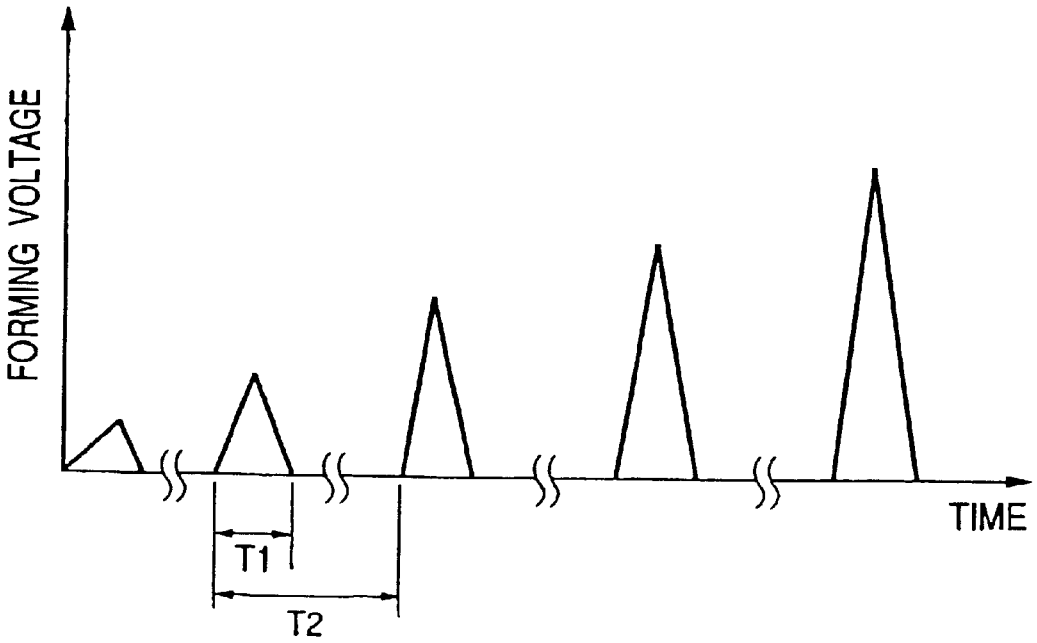

An example of a voltage waveform of the forming will now be shown in FIGS. 5A and 5B.

As the voltage waveform, a pulse waveform is particularly preferable, and there are two cases, i.e., continuous application of a voltage pulse with a pulse wave height value determined as a constant voltage (FIG. 5A) and application of the voltage pulse while increasing the pulse wave height value (FIG. 5B).

Description will be first given as to the case where the pulse wave height value is determined as a constant value. Reference characters T1 and T2 in FIG. 5A denote a pulse width and a pulse gap of the voltage waveform. For example, assuming that T1 is 1 $\mu$s to 10 ms and T2 is 10 $\mu$s to 100 m seconds, a wave height value (a peak voltage in forming) is appropriately selected in accordance with the conformation of the above-described surface conduction electron emitting device to be applied in the vacuum atmosphere having a suitable degree of vacuum for several seconds to several score minutes. It is to be noted that the voltage waveform to be applied may have a rectangular wave as well as an illustrated triangular wave.

Description will now be given as to the case where the voltage pulse is applied while increasing the pulse wave height value. Reference characters T1 and T2 in FIG. 5B are the same as those in FIG. 5A, and the wave height value (the peak voltage in forming) is increased, for example, at 0.1 V step increments to be applied in the appropriate vacuum atmosphere similar to that in the explanation in connection with FIG. 5A.

Further, it is preferable that the resistivity of the conductive film 3 obtained after forming is sufficiently uniformly reduced by carrying out, e.g., the reduction process while performing exposure in the reduced gas (hydrogen) atmosphere or heating the substrate after completion of forming.

The electron emitting device according to the first embodiment described with reference to FIGS. 1A and 1B can be produced by the above processes.

4) Further, it is preferable that an activating process is performed in addition to the above-described processes.

The activating process means such a process as that application of a pulse with a pulse wave height value as a constant voltage is repeated in, e.g., the atmosphere in which an organic substance exists as similar to the explanation of the forming process and that can greatly improve the state of a device current or an emission current by depositing carbon on the conductive film 3 or in the gap 2 from the organic substance existing in the atmosphere. If the activating process is performed while measuring, e.g., a device current or an emission current so that the process is completed when, e.g., the emission current is saturated, the process is preferably effective. In addition, the pulse wave height value in the activating process is preferably a wave height value of a drive voltage applied when driving the device. With this activating process, a carbon film 6 is generated (FIG. 3D) and the above-mentioned electron emitting device according to the second embodiment depicted in FIGS. 2A and 2B are created.

It is to be noted that the carbon is graphite (which indicates both monocrystal and polycrystal) and amorphous carbon (which indicates the amorphous carbon and a mixture of the amorphous carbon and the polycrystal graphite). Further, a deposited film thickness is preferably not more than 500 Å, or more preferably not more than 300 Å.

The basic characteristic of the thus obtained surface conduction electron emitting device will be described hereinafter.

Figure 6:
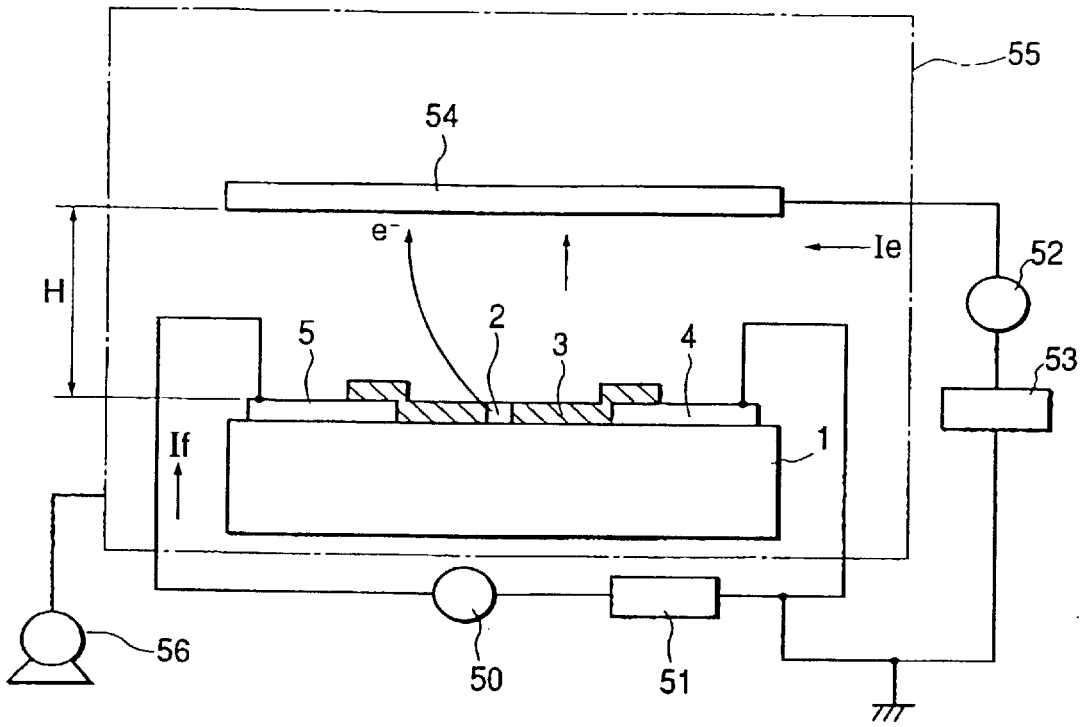
FIG. 6 is a schematic drawing of a measurement evaluation system for measuring an electron emitting characteristic of the surface conduction electron emitting device.

FIG. 6 is a schematic block diagram showing an example of a measurement evaluation system for measuring an electron emitting characteristic of the surface conduction electron emitting device, and this measurement evaluation system will be first explained.

In FIG. 6, like reference numerals in FIGS. 1A and 1B denote like or corresponding parts. Reference numeral 51 designates a power supply for applying a device voltage Vf to the device; 50, an ampere meter for measuring a device current If flowing through the conductive thin film 3 between the device electrodes 4 and 5; 54, an anode electrode for capturing an emission current Ie emitted from the electron emitting section 2; 53, a high-voltage power supply for applying a voltage to the anode electrode 54; 52, an ampere meter for measuring an emission current Ie emitted from the electron emitting section 2; 55, a vacuum equipment; and 56, an exhaust pump.

The surface conduction electron emitting device, the anode electrode 54 and others are set in the vacuum equipment 55, and the vacuum equipment 55 is provided with necessary devices such as a non-illustrated vacuum gauge so that the measurement of the surface conduction electron emitting device can be evaluated in a desired vacuum state.

The exhaust pump 56 is constituted by a normal high vacuum equipment system composed of a turbo pump, a rotary pump and others, and a ultra-high vacuum equipment system composed of an ion pump and others. Further, the entire vacuum equipment 55 and the substrate 1 of the surface conduction electron emitting device can be heated up to 300° C. by a heater. Incidentally, when the measurement evaluation system constitutes the display panel and the inside thereof as the vacuum equipment 55 and the inside thereof in the later-described assembly process of the display panel (see 201 in FIG. 9), the measurement evaluation system can be applied to the measurement evaluation and process in the forming process and the activating process described above.

Regarding to the basic characteristic of the surface conduction electron emitting device described as follows, it is assumed that a voltage of the anode electrode 54 in the measurement evaluation system is 1 kV to 10 dV and a distance H between the anode electrode 54 and the surface conduction electron emitting device is 2 mm to 8 mm, and the regular measurement is carried out.

Figure 7:
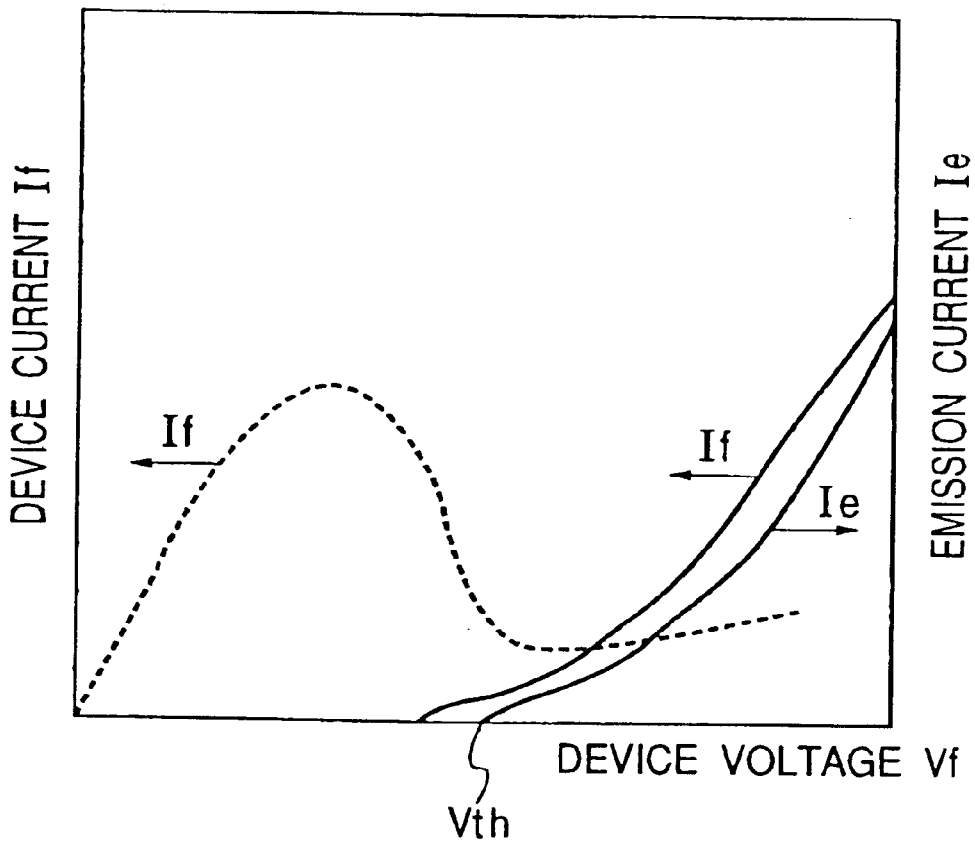
FIG. 7 is a view showing a typical example of the relationship between an emission current Ie, a device current If and a device voltage Vf of the surface conduction electron emitting device according to the present invention.

At first, FIG. 7 shows a typical example of the relationship between the emission current Ie, the device current If and the device voltage Vf (solid lines in the drawing). It is to be noted that the emission current Ie is very smaller than the device current If in FIG. 7, it is shown in an arbitrary unit.

As apparent from FIG. 7, the surface conduction electron emitting device has the following three characteristic properties with respect to the emission current Ie.

In the first place, when the device voltage Vf not less than a given voltage (which is represented by Vth in FIG. 6 and referred to as "a threshold voltage" hereinafter) is applied to the surface conduction electron emitting device, the emission current Ie rapidly increases whilst the emission current Ie is hardly detected when the voltage is not more than the threshold voltage Vth. That is, the surface conduction electron emitting device is a non-linear device having the clear threshold voltage Vth with respect to the emission current Ie.

In the second place, since the emission current Ie has such a characteristic as that it flatly increases with respect to the device voltage Vf (which is referred to as an MI characteristic), the emission current Ie can be controlled by the device voltage Vf.

In the third place, an emission charge captured by the anode electrode 54 (see FIG. 6) depends on a time for applying the device voltage Vf. That is, an amount of charge captured by the anode electrode 54 can be controlled by the time for applying the device voltage Vf.

As to the characteristic represented by the solid lines in FIG. 7, although the emission current Ie has the MI characteristic with respect to the device voltage Vf and the device current If has the MI characteristic with respect to the device voltage Vf, the device current If may demonstrate a voltage control negative resistance characteristic (which will be referred to as "a VCNR characteristic" hereunder) with respect to the device voltage Vf in some cases as shown by a broken line in FIG. 7. The measurement condition and others during production and measurement of the device influence either the characteristic to be demonstrated. However, even in the case of the device with the device current If having the VCNR characteristic with respect to the device voltage Vf, the emission current Ie has the MI characteristic with respect to the device voltage Vf.

With the characteristic properties of the surface conduction electron emitting device described above, even an electron source, an image forming apparatus and others having a plurality of devices arranged therein can readily control an amount of electrons to be emitted in accordance with an input signal, thereby being applied to the various fields.

Description will now be made as to an arrangement of the surface conduction electron emitting devices in the electron source according to the present invention.

As a mode for arranging the surface conduction electron emitting devices in the electron source according to the present invention, there is an arrangement mode in which n Y-direction wires are provided on m X-direction wires via an interlayer insulation layer and the X-direction wires and the Y-direction wires are respectively connected to a pair of device electrodes of the surface conduction electron emitting device, as well as a ladder-type arrangement. This will be referred to as a simple matrix arrangement hereunder.

According to the above-described basic characteristic of the surface conduction electron emitting device, when the device voltage Vf to be applied exceeds the threshold voltage Vth, an electron emission amount can be controlled by the wave height value and the pulse width of the pulse-type voltage to be applied. On the other hand, when the device voltage Vf is not more than the threshold voltage Vth, the electrons are hardly emitted. Therefore, even when a plurality of the surface conduction electron emitting devices are arranged, the pulse-type voltage controlled in accordance with the input signal can be applied and the respective devices can be selected to be independently driven only with the simple matrix wiring.

The simple matrix wiring is based on the above-mentioned principle, and the structure of the electron source having the simple matrix arrangement as an example of the electron source according to the present invention will now be explained with reference to FIG. 8.

Figure 8:
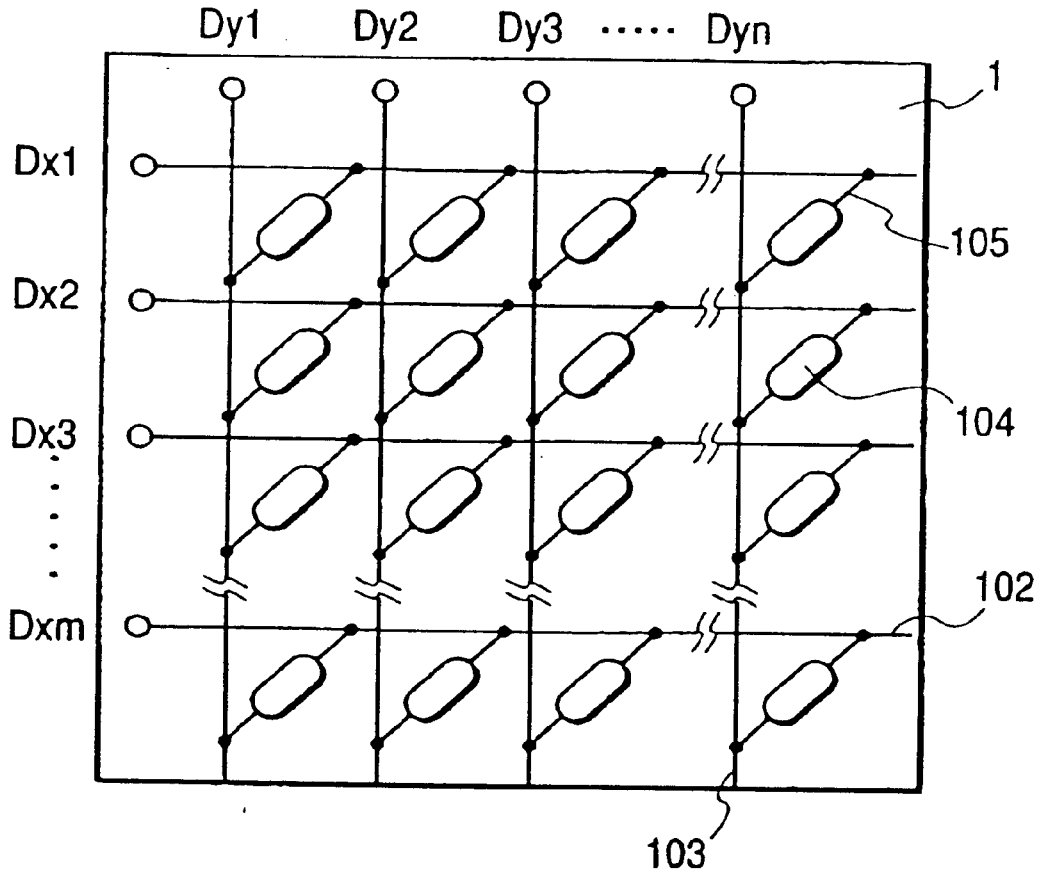
FIG. 8 is a schematic view of an electron source in a simple matrix arrangement.

In FIG. 8, the substrate 1 is a glass plate and the like which has been already described, and a number and a shape of the surface conduction electron emitting devices 104 arranged on the substrate 1 are appropriately set in accordance with an application.

The m X-direction wires (wires in a direction of lines) 102 respectively have external terminals Dx1, Dx2, . . . , Dxm and correspond to a conductive metal film formed on the substrate 1 by the vacuum evaporation method, the printing method, the spattering method and the like. Further, materials, a film thickness and a wiring width are so set as to substantially uniformly supply the voltage to the plural surface conduction electron emitting devices 104.

The n Y-direction wires (wires in a direction of rows) 103 respectively have external terminals Dy1, Dy2, . . . , Dyn and are produced similarly as to the X-direction wires 102.

A non-illustrated interlayer insulation layer is provided between the m X-direction wires 102 and the n Y-direction wires 103 and these two types of wires are electrically separated to form a matrix wiring. It is to be noted that both m and n are positive integers.

The non-illustrated interlayer insulation layer is $SiO_2$ and the like formed by the vacuum evaporation method, the printing method, the spattering method and others and formed into a desired shape on the entire or partial area of the substrate 1 having the X-direction wires 102 formed thereon and, in particular, a film thickness, a material and a manufacturing method are appropriately set so as to withstand a difference in potential at an intersection of the X-direction wires 102 and the Y-direction wires 103.

The opposed electrodes (not shown) of the surface conduction electron emitting device 104 are electrically connected to each other by the m X-direction wires 102, the n Y-direction wires 103 and a wire connection constituted by a conductive metal and the like formed by the vacuum evaporation, the printing method, the spattering method and the others.

Here, the constituent elements of the m X-direction wires 102, the n Y-direction wires 103, the wire connection 105 and the opposed device electrodes may be entirely or partially the same or different and appropriately selected in accordance with the material and others of the above-described device electrodes. Further, the wiring to these device electrodes may be generically referred to as a device electrode when its material is the same as that of the device electrodes. Furthermore, the surface conduction electron emitting device 104 may be formed on the substrate 1 or the non-illustrated interlayer insulating layer.

Although described in detail later, non-illustrated scan signal applying means for applying a scan signal is electrically connected to the X-direction wires 102 in order to scan the lines of the surface conduction electron emitting devices 104 arranged in the X direction in accordance with an input signal.

On the other hand, non-illustrated modulation signal applying means for applying a modulation signal is electrically connected to the Y-direction wires 103 in order to modulate each row of the surface conduction electron emitting devices 104 arranged in the Y direction in accordance with an input signal. A drive voltage applied to each surface conduction electron emitting device 104 is supplied as a difference voltage between the scan signal and the modulation signal applied to that device.

Figure 9:
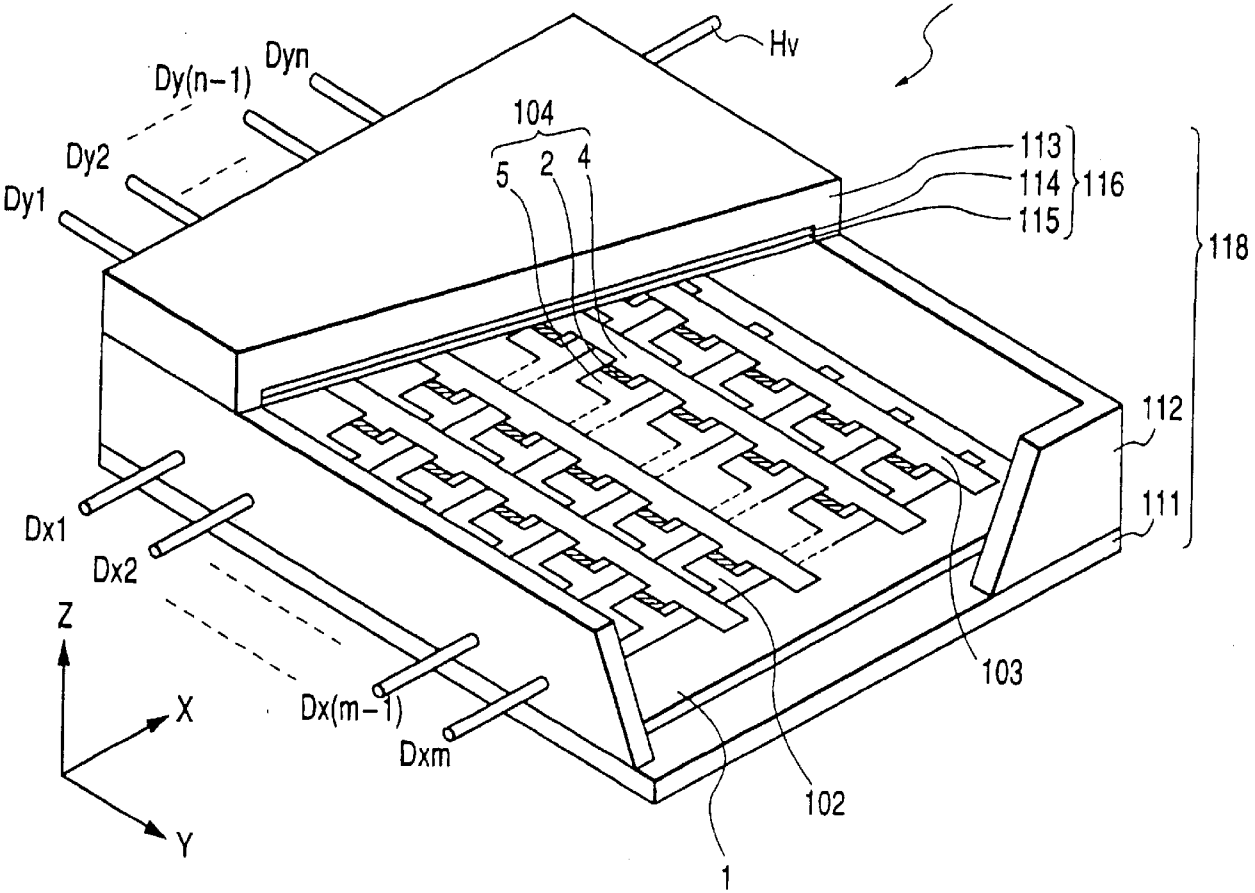
FIG. 9 is a partially-cut perspective view showing a schematic structure of a display panel having an electron source in a simple matrix arrangement.
Figure 10A:
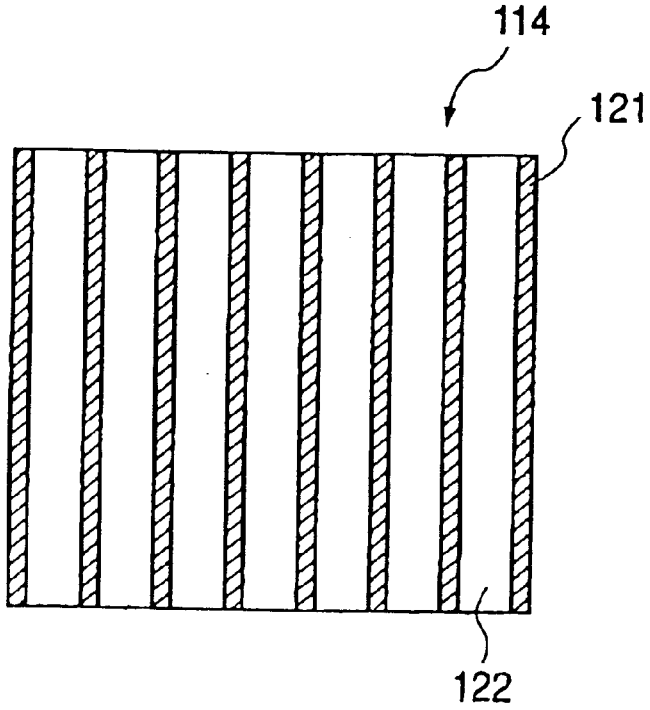
FIGS. 10A and 10B are views showing a structural example of a fluorescent screen used in the display panel.
Figure 10B:
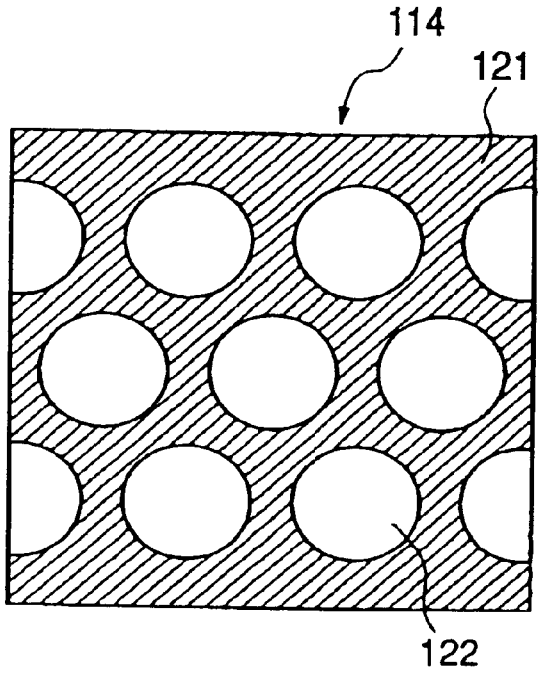
Figure 11:
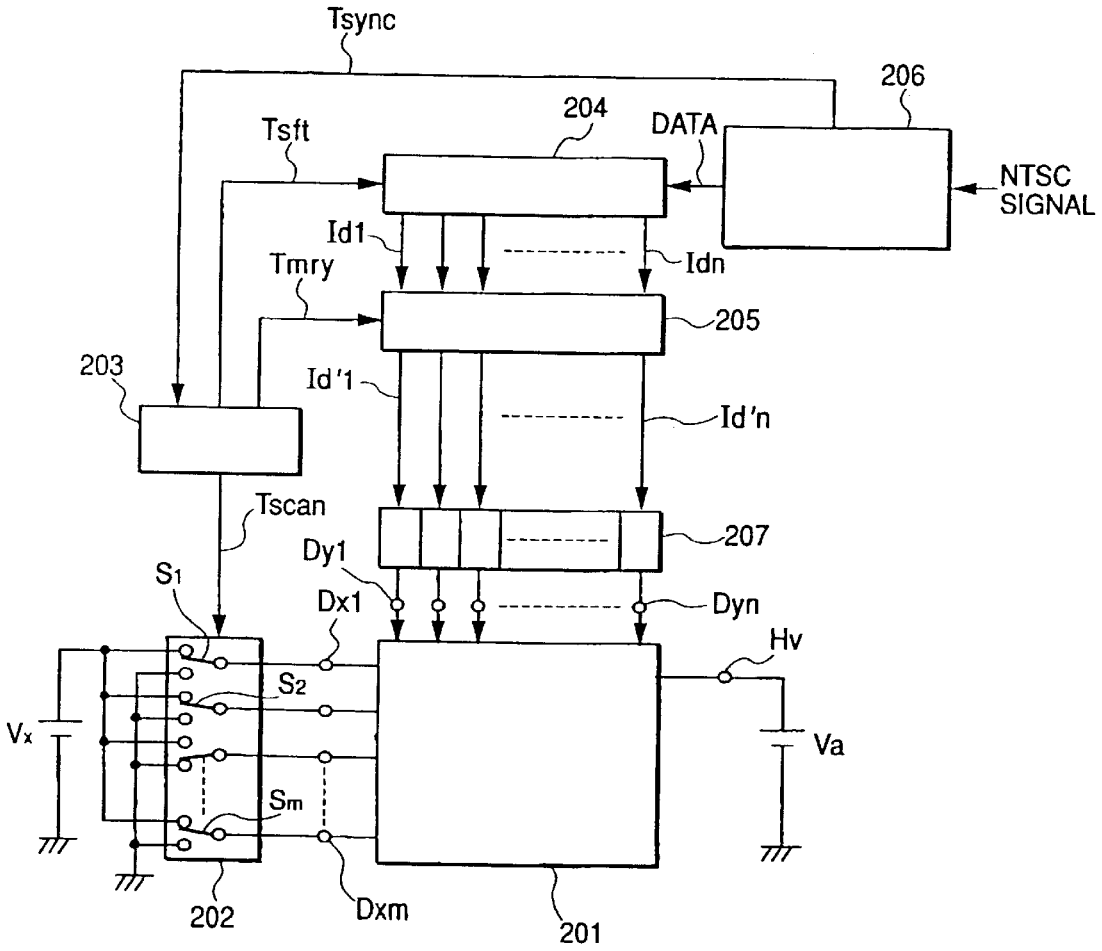
FIG. 11 is a block diagram showing an example of a drive circuit for an image forming apparatus performing image display in accordance with a television signal in an NTSC mode.

An example of the image forming apparatus according to the present invention using the above-descibed simple matrix arrangement will now be described with reference to FIGS. 9 to 11. FIG. 9 shows a basic structure of a display panel 210; FIGS. 10A and 10B are views showing a fluorescent screen 114; and FIG. 11 is a block diagram showing an example of a drive circuit for performing television display on the display panel 201 of FIG. 8 in accordance with a television signal adopting an NTSC mode.

In FIG. 9, reference numeral 1 denotes a substrate of the electron source on which the surface conduction electron emitting devices 104 are arranged as described above; 111, a rear plate to which the substrate 1 is fixed; 116, a face plate having a fluorescent screen 114 and a metal back 115 and the like which are image forming members formed on the inner surface of a glass substrate 113; and 112, a supporting frame. Frit glass and the like is applied to a joining portion of the rear plate 111, the supporting frame 112 and the face plate 116, and this portion is baked in the atmosphere or in the nitrogen or argon atmosphere at 400° C. to 500° C. for more than 10 minutes to be sealed, thereby constituting an envelope 118.

In FIG. 9, reference numeral 2 denotes a gap in FIGS. 1A and 1B or a gap having the carbon film 6 in FIGS. 2A and 2B. Reference numerals 102 and 103 designate X-direction wires and Y-direction wires connected to a pair of electrodes 4 and 5 (see FIGS. 1A and 1B) of the surface conduction electron emitting device 104, each of which has external terminals Dx1 to Dxm or Dy1 to Dyn.

The envelope 118 is constituted by the face plate 116, the supporting frame 112 and the rear plate 111 as described above. However, the rear plate 111 is mainly provided for the purpose of increasing the strength of the substrate 1 and, when the substrate 1 itself has the sufficient strength, the separate rear plate 111 is unnecessary, and the supporting frame 112 may be directly sealed to the substrate 1 to constituting the envelope 118 by using the face plate 116, the supporting frame 112 and the substrate 1. Further, when a non-illustrated supporting frame called a spacer is further provided between the face plates 111, it is possible to obtain the envelope 118 which has the sufficient strength with respect to an ambient pressure.

Although the fluorescent screen 114 is composed of only a fluorescent material 112 in case of monochrome, it is composed of a black conductive material 121 called a black stripe (FIG. 10A) or a black matrix (FIG. 10B) and the fluorescent material 122 by arrangement of the fluorescent material 122 in case of color. The purpose of providing the black stripe and the black matrix is to cast a mixed color in the shade by darkening separate coating sections between the respective three-primary-color fluorescent materials 122 which are required in case of color display and to suppress reduction in contrast due to external light reflection in the fluorescent screen 114. As a substance of the black conductive member 121, it is possible to use any material as long as that material has conductivity and less light transmittance and reflection, as well as a frequently-used material having black lead as a main component. A precipitation method or a printing method are used irrespective of monochrome or color as a method for coating the fluorescent material 122 to the glass plate 113.

As shown in FIG. 9, the metal back 115 is usually provided on the inner surface of the fluorescent screen 114. The purpose of the metal back 115 is improvement of the brightness by causing a light ray toward the inner surface in the light emitted from the fluorescent screen 122 (see FIGS. 10A and 10B) to be mirror-reflected to the face plate 116, behavior as an electrode for applying an electron beam accelerating voltage from a high-voltage terminal Hv, protection of the fluorescent screen 122 from a damage caused due to collision of negative ions generated in the envelope 118, and others. After producing the fluorescent screen 114, the metal back 115 can be manufactured by carrying out the smoothing process (which is usually referred to as filming) of the inner-side surface of the fluorescent screen 114 and depositing A1 by the vacuum evaporation and the like.

To the face plate 116 may be provided a transparent electrode (not shown) on the outer surface side of the fluorescent screen 114.

When conducting the above-described sealing, since each color fluorescent material 122 must be associated with the surface conduction electron emitting device in case of color, positioning must be sufficiently carried out.

The inside of the envelope 118 is caused to have a degree of vacuum which is approximately $10^{-7}$ Torr through a non-illustrated exhaust pipe and sealed. Immediately before or after sealing the envelope 118, the getter process may be carried out. In the getter process, a getter (not shown) provided at a predetermined position in the envelope 118 is heated by a heating method such as resistance heating or high-frequency heating to form a deposited film. The getter usually has Ba and the like as a main component and is designed to maintain the degree of vacuum, e.g., approximately $10^{-5}$ to $10^{-9}$ Torr by absorption of the deposited film.

The subsequent process for manufacturing the surface conduction electron emitting device such as the forming or the activation described above is conducted immediately before or after sealing the envelope 118. In order to uniformly lead or exhaust gas into or from the envelope 118 (induction and exhaust of the hydrogen in the forming, induction and exhaust of the organic compound gas in the activation) and to suppress losses on spoilage due to bringing of the wiring to the outside of the envelope, it is desirable to effect the forming, the activation and the subsequent manufacturing process before sealing. Since the resistivity of the conductive thin film 3 in the present invention does not prominently vary even if the high-temperature heating process which seems to be necessary in, e.g., the sealing process is carried out at 350° C. to 450° C. for several minutes to several score minutes, losses on spoilage can be suppressed by carrying out sealing of the envelope 118 after the forming and activating processes, which is preferable.

The above-described display panel 201 can be driven by a drive circuit such as shown in FIG. 11. It is to be noted that reference numeral 201 denotes the display panel; 202, a scanning circuit; 203, a control circuit; 204, a shift register; 205, a line memory; 206, a sync signal separating circuit; 207, a modulation signal generator; and Vx and Va, direct-current voltage sources in FIG. 11.

As shown in FIG. 11, the display panel 201 is connected to an external electric circuit through the external terminals Dx1 to Dxm, the external terminals Dy1 to Dyn and the high-voltage terminal Hv. In these members, to the external terminals Dx1 to Dxm are applied a scan signal which is used to sequentially drive the surface conduction electron emitting devices provided in the display panel 201, i.e., a device group matrixed in the form of a procession of m lines x n rows in accordance with each line (n devices).

On the other hand, a modulation signal for controlling an output electron beam for each device in one line selected by the scan signal is applied to the external terminals Dy1 to Dyn. Additionally, a direct-current voltage of, e.g., 10 kV is supplied to the high-voltage terminal Hv by the direct-current voltage source Va. This is an accelerating voltage for giving energy sufficient for exciting the fluorescent material to the electron beam outputted from the surface conduction electron emitting device.

The scanning circuit 202 is provided with m switching devices (which are typically represented by S1 to Sm in FIG. 11), and the respective switching devices S1 to Sm select either an output voltage from the direct-current voltage source Vx or 0 V (ground level) and are electrically connected to the external terminals Dx1 to Dxm of the display panel 201. The respective switching devices S1 to Sm operate based on a control signal Tscan outputted from the control circuit 203 and in a practical sense, they can be readily constituted by combining devices having a switching function, e.g., an FET.

The direct-current voltage source Vx in the present invention is designed to output based on a characteristic (the threshold voltage) of a surface conduction electron emitting device such as shown in FIG. 7 a constant voltage by which the drive voltage applied to the non-scanned surface conduction electron emitting device is not more than the threshold voltage Vth.

The control circuit 203 functions to match operations of the respective sections so that the appropriate display is effected based on an image signal inputted from the outside. Based on a sync signal Tsync transmitted from the sync signal separating circuit 206 which will be explained next, control signals Tscan, Tsft and Tmry for the respective sections are generated.

The sync signal separating circuit 206 is a circuit for separating a sync signal component and a brightness signal component from a television signal in the NTSC mode inputted from the outside and, as is well known, this circuit can be readily constituted by using a frequency separating (filter) circuit. As is also well know, the sync signal separated by the sync signal separating circuit 206 is composed of a vertical sync signal and a horizontal sync signal. This sync signal is represented as Tsync in the drawing for the sake of convenience. Meanwhile, the brightness signal component for an image separated from the television signal is represented as a DATA signal in the drawing for the sake of convenience. This DATA signal is inputted to the shift register 204.

The shift register 204 is designed to serial-to-parallel-convert the DATA signal serially inputted in time series in accordance with each line of an image and operates based on the control signal Tsft fed from the control circuit 203. In other words, this control signal Tsft is a shift clock of the shift register 204. Further, the serial-to-parallel-converted data for one line of an image (corresponding to drive data for n surface conduction electron emitting devices) is outputted as n parallel signals Id1 to Idn from the shift register 204. The line memory 205 is a storage apparatus for storing the data for one line of an image for a necessary time and appropriately stores the content of Id1 to Idn in accordance with the control signal Tmry supplied from the control circuit 203. The stored content is outputted as Id'1 to Id'n to be inputted to the modulation signal generator 207.

The modulation signal generator 207 is a signal line for appropriately drive-modulating each of the surface conduction electron emitting devices in accordance with the image data Id'1 to Id'n, and its output signal is applied to the surface conduction electron emitting devices in the display panel 201 through the external terminals Dy1 to Dyn.

As described above, the surface conduction emitting device has a clear threshold voltage for electron emission, and electron emission is generated only when a voltage over the threshold voltage is applied. Further, the emission current also varies with respect to a voltage over the threshold voltage in accordance with a change in voltage applied to the surface conduction electron emitting device. Although a change in material or structure of the surface conduction electron emitting device or a change in manufacturing method may alter a value of the threshold voltage or a degree of change in emission current with respect to the applied voltage, the following can be true.

That is, when applying a pulse-type voltage to the surface conduction electron emitting device, application of, e.g., a voltage less than the threshold voltage does not cause electron emission, but application of a voltage over the threshold voltage causes electron emission. In that event, at first, changing a wave height value of the voltage pulse can control the intensity of the electron beam to be outputted. At second, changing a width of the voltage pulse can control a total amount of charge of the electron beam to be outputted.

Therefore, as a mode for modulating the surface conduction electron emitting device in accordance with an input signal, there are a voltage modulation mode and a pulse modulation mode. When employing the voltage modulation mode, a circuit adopting the voltage modulation mode by which a voltage pulse having a constant length is generated but a wave height value of the pulse can be appropriately modulated in accordance with the data to be inputted is used as the modulation signal generator 207. When employing the pulse width modulation mode, there is used a circuit adopting the pulse width modulation mode by which the voltage pulse having a constant wave height value is generated but the pulse width can be appropriately modulated in accordance with the data to be inputted as the modulation signal generator 207.

The shift register 204 or the line memory 205 may be associated with either the digital signal mode or the analog signal mode, and either type can be used as long as the serial-to-parallel conversion of an image signal or storage can be carried out at a predetermined speed.

When using the digital signal mode, the output signal DATA from the sync signal separating circuit 206 must be converted into a digital signal. This is enabled by providing an A/D converter to an output section of the sync signal separating circuit 206.

In connection with this, a circuit provided to the modulation signal generator 207 slightly differs depending on the output signal of the line memory 205 being a digital sianal or an analog signal.

That is, in case of the voltage modulation mode using the digital signal, for example, a well-known D/A conversion circuit may be used for the modulation signal generator 207 and an amplifying circuit and others may be added thereto if necessary. Further, in case of the pulse width modulation mode using the digital signal, the modulation signal generator 207 can be easily constituted by using a circuit in which a high-speed oscillator, a counter for calculating a wave number outputted from the oscillator and a comparator for comparing an output value of the counter and an output value of the memory are combined for example. Further, it may be also possible to add an amplifier for voltage-amplifying the modulation signal which is outputted from the comparator and subjected to the pulse width modulation to a drive voltage for the surface conduction electron emitting device.

Meanwhile, in case of the voltage modulation mode using the analog signal, for example, an amplifying circuit using a well-known operation amplifier and the like may be used for the modulation signal generator 207 and a level shift circuit and others may be added thereto if necessary. Moreover, in case of the pulse width modulation mode using the analog signal, for example, a well-known voltage control oscillation circuit (VCO) may be used and an amplifier for voltage-amplifying the signal to a drive voltage for the surface conduction electron emitting device may be added thereto if necessary.

The image forming apparatus according to the present invention having the display panel 201 and the drive circuit described above can emit electrons from an arbitrary surface conduction electron emitting device 104 by applying a voltage from the external terminals Dx1 to Dxm and Dy1 to Dyn, accelerate the electron beam by applying a high voltage to the metal back 115 or the transparent electrode (not shown) through the high voltage terminal Hv and perform television display in accordance with the television signal in the NTSC mode by excitation/light emission generated by colliding the accelerated electron beam against the fluorescent screen 114.

The above-described structure is a schematic configuration necessary for obtaining the image forming apparatus according to the present invention used in display and the like, and the detailed part such as materials of respective members is not restricted to the above content but appropriately selected so as to be suitable for applications of the image forming apparatus. Further, although the NTSC mode has been described for the input signal, the image forming apparatus according to the present invention is not limited thereto, and any other mode such as PAL, SECAM and the like may be used or a high-fidelity TV mode like a MUSE mode using a TV signal with more scanning lines may be adopted. Additionally, although the description of the present invention has been given as to the simple matrix mode as the image display apparatus adopting the most preferable simple drive mode and drive wiring, use of the ladder type arrangement can perform the similar television display and a preferable image forming apparatus can be obtained as a display device in, e.g., a television conference system or a computer as well as a display device for the television broadcast explained above. Moreover, the image forming apparatus can be also used as an exposure apparatus for an optical printer constituted by a photosensitive drum and others.

The present invention will be further described hereunder in conjunction with embodiments and comparative examples.

EMBODIMENT 1

In this embodiment, description will be made on an example where the surface conduction electron emitting device having the structure shown in FIGS. 2A and 2B is produced. FIG. 2A is a top plan view of the surface conduction electron emitting device and FIG. 2B is a cross-sectional view of the same. In the drawings, reference character L denotes a gap between the device electrodes 4 and 5; W1, a width of the device electrode; and W2, a width of the conductive film 3.

With reference to FIGS. 3A to 3D, a method for manufacturing the surface conduction electron emitting device of this embodiment will now be explained.

1) A quartz substrate is used as the substrate 1 and, after sufficiently cleaning the substrate 1 with an organic solvent, the device electrodes 4 and 5 consisting of Pt are formed on the substrate 1 by a generic vacuum forming technique or the photolithography technique (FIG. 3A). Here, it is assumed that the gap L between the device electrodes is 10 $\mu$m; the length W1, 600 $\mu$m; and the thickness d, 1000 Å in FIGS. 2A and 2B.

2) The water solution was adjusted in such a manner that palladium acetate (II) monoethanolamine complex is 9.8 m mol/1, platinum acetate (II) monoethanolamine complex is 4.2 m mol/1, IPA (isopropyl alcohol) is 15 wt %, and an ink jet apparatus adopting a bubble jet mode was used as a droplet supplying apparatus so that the water solution was made into droplets to be supplied between the device electrodes 4 and 5 multiple times.

3) The heating process was carried out at 350° C. for 30 minutes and a fine-grain film consisting of palladium oxide and platinum was formed as the conductive film 3 (FIG. 3B. At this time, the fine grains of palladium oxide and platinum were not separated to be formed but they were formed as a substantially uniform fine-grain film.

4) The substrate 1 having the device electrodes 4 and 5 and the conductive film 3 formed thereon was set in the vacuum equipment 55 of the measurement evaluation system in FIG. 6, and exhaust was performed by the exhaust pump 56 so that the inside of the vacuum equipment 55 had a degree of vacuum of approximately $10^{-5}$ Torr. A voltage was thereafter applied between the device electrodes 4 and 5 by the power supply 51 for applying the device voltage Vf, and the forming was conducted while gradually inducting gas having 2% of hydrogen and 98% of nitrogen immediately after application of the voltage. The voltage waveform in the forming was determined as a rectangular wave of 1 ms/10 ms.

5) As described above, in regard to the device voltage Vf in the forming in 4), there is used a value which is higher than the voltage Vf2 (the voltage Vf with which the device current If starts to fall) with which the forming begins when the applied voltage Vf is gradually increased after the device is sufficiently reduced by previously hydrogen-exposing it in the vacuum equipment and which is smaller than the voltage Vf1 with which the forming begins when the applied voltage Vf is gradually increased without reducing the device in the vacuum equipment. Vf2 and Vf1 are typically as shown in FIG. 4A with a composition ratio of palladium acetate (II) monoethanolamine complex and platinum acetate (II) monoethanolamine complex in the water solution in 1), and the effect for suppressing the forming power by inducing hydrogen can be obtained with the platinum (A) composition ratio x % is not more than 50%. Therefore, the forming voltage of 4) in this range is used. It is to be noted that forming of the device was completed in approximately 10 minutes with the forming voltage 8 V and the crack 2 was formed to the conductive film 3 (FIG. 3C).

Figure 3D:
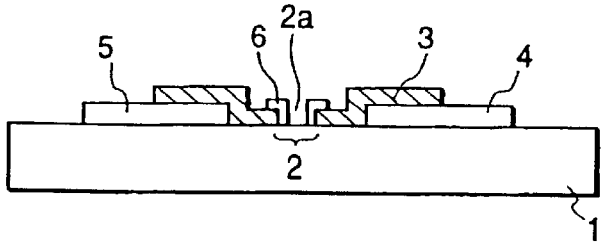

6) Subsequently, the activating process is applied to the device subjected to the forming process. Upon completion of forming, the inside of the vacuum equipment 55 was again evacuated so that the inside of the vacuum equipment 55 had a degree of vacuum of $10^{-7}$ Torr. Benzonitrile was used as an organic compound for activation and a non-illustrated variable leak valve was gradually opened to induce the benzonitrile to impart a degree of vacuum of $10^{-6}$ Torr to the inside of the vacuum equipment 55. When the degree of vacuum became sufficiently constant after inducing the benzonitrile, the voltage was then applied between the device electrodes 4 and 5. A bipolar rectangular wave of 1 ms/10 ms and 15 V was used for the activating process. Further, the time for performing the activating process was one hour, and the process continued until an increase in the device current If due to the activating process was not observed and If showed a substantially constant value. The carbon film 6 was formed on the conductive film 3 and in the crack 2 by the activating process (FIG. 3D).

It is to be noted that the forming power of the device in this embodiment could be reduced to approximately 70% on the average as compared with the device in which the conductive film 3 was produced using only Pd.

The electron emitting characteristic of the surface conduction electron emitting device according to the present invention was measured by using the above-described measurement evaluation system is illustrated in FIG. 6. The measurement condition was that a distance H between the anode electrode 54 and the surface conduction electron emitting device was 4 mm; a potential of the anode electrode 54, 1 kV; and a degree of vacuum in the vacuum equipment 55 during the electron emitting characteristic measurement, approximately $1\times10^{-8}$ Torr.

As a result, a current-voltage characteristic of the device in this embodiment such as represented by the solid lines in FIG. 7 was obtained with respect to multiple times of production. The typical device characteristic was that the device current If=1.0 mA and the emission current Ie=1 $\mu$A with the device voltage Vf=15 V, and irregularity in the plural devices was hardly observed.

COMPARATIVE EXAMPLE 1

Although the current-voltage characteristic such as represented by the solid lines in FIG. 7 was obtained with respect to multiple times of production even in the device which was manufactured as similar to the embodiment 1 except that the conductive film 3 was constituted by only Pd with Pd acetate (II) monoethanolamine complex being set to 14 m mol/1 and platinum acetate (II) monoethanolamine complex being set to 0 m mol/1, the device characteristic similar to that in this embodiment was not necessarily obtained, and the device current If became small in some cases.

EMBODIMENT 2

In this embodiment, description will be given as to an example where such an image forming apparatus as shown in FIG. 9 was produced by using an electron source such as shown in FIG. 8 in which a plurality of surface conduction electron emitting devices depicted in FIGS. 2A and 2B were arranged in a simple matrix.

The electron source was manufactured by extending each pattern of the device electrodes 4 and 5 and the conductive film 3 described in connection with the embodiment 1, forming a plurality of surface conduction electron emitting devices and forming X-direction wires (which are also referred to as lower wires or line-direction wires) 102 and Y-direction wires (which are also referred to as upper wires or row-direction wires) 103 at the same time.

With reference to FIGS. 9, 10A and 10B, an example where the image forming apparatus was constituted by using a non-formed electron source substrate in which the thus produced plural conductive films are matrix-wired by the multiple X-direction wires and the multiple Y-direction wires.

The non-formed electron source substrate 1 was first set in a vacuum equipment 55 as shown in FIG. 6, and a vacuum pump 56 was used to perform evacuation so that a degree of vacuum in the vacuum equipment became $10^{-5}$ Torr. As similar to the embodiment 1, a voltage was then applied between the device electrodes 4 and 5 via the external terminals respectively connected to the X-direction wires and the Y-direction wires by a power supply 51 for applying the device voltage Vf, and gas containing 2% of hydrogen and 98% of nitrogen was gradually induced immediately after application of the voltage to simultaneously perform forming, thereby producing a crack 2 on each conductive film 3.

Subsequently, a voltage was applied between the respective device electrodes 4 and 5 through the external terminals respectively connected to the X-direction wires and the Y-direction wires in the benzonitrile atmosphere to conduct the activating process. The activating step was carried out similarly to the embodiment 1 and completed when an increase in device current If became still.

Thereafter, upon fixing the electron source substrate 1 subjected to the forming and activating processes to the rear plate 111, the face plate 116 (constituted by forming the fluorescent screen 114 and the metal back 115 which are the image forming members on the inner surface of the glass substrate 113) was positioned above the substrate 1 by 4 mm through the supporting frame 112; the frit glass was applied to the joining portion of the face plate 116, the supporting frame 112 and the rear plate 11; and sealing was carried out by baking at 420° C. for more than 10 minutes in argon (see FIG. 8). The frit glass was also used to fix the substrate 1 to the rear plate 111.

Although the fluorescent screen 114 which is the image forming member is composed of only a fluorescent material in case of monochrome, a stripe type fluorescent material (see FIG. 10A) was adopted in this embodiment. Black stripes were first formed by a black conductive material 121 and each colored fluorescent material 122 was then applied to the gap portions by the slurry method to manufacture the fluorescent screen 114. As the black conductive material 121, a frequently used material having black lead as a main component was used.

Further, the metal back 115 was provided on the inner surface side of the fluorescent screen 114. The metal back 115 was produced by performing the smoothing process (which is usually referred to as filming) on the surface of the fluorescent screen 114 on the inner surface side after production of the fluorescent screen 114 and then carrying out vacuum evaporation of A1.

Although a transparent electrode may be provided to the face place 116 on the outer surface side of the fluorescent screen 114, this was omitted in this embodiment because the sufficient conductivity was obtained by only the metal back 115.

Since each colored fluorescent material 122 must be associated with the surface conduction electron emitting device 104 when effecting the above-described sealing in case of color, positioning was sufficiently carried out.

Thereafter, a degree of vacuum of approximately $10^{-7}$ Torr was obtained in the envelope 118 through the non-illustrated exhaust pipe, and this pipe was heated by a burner to be deposited, thereby sealing the envelope 118. At last, the getter process was conducted by the high-frequency heating method in order to maintain the degree of vacuum after sealing. A main component of the getter was Ba.

As described above, in the display panel 201 (see FIG. 9) configured by using the electron source adopting the simple matrix arrangement, a scan signal and a modulation signal were applied to each surface conduction electron emitting device 104 through the external terminals Dx1 to Dxm and Dy1 to Dyn by a non-illustrated signal generator to perform electron emission; a high voltage equal to or more than several kV was applied to the metal back 115 through the high voltage terminal Hv so that the electron beam was accelerated to collide with the fluorescent screen 114; and excitation and light emission were carried out to display an image. Consequently, the electron emission characteristic substantially similar to that of the device in the vacuum equipment according to the embodiment 1 was obtained in the surface conduction electron emitting device used in this embodiment. Further, irregularity in the multiple devices was hardly observed, and an image with the high brightness and the high definition was stably displayed for a long period of time without reduction in brightness.

COMPARATIVE EXAMPLE 2

On the contrary, after the forming process similar to that in the embodiment 2 was conducted by using the electron source substrate produced as similarly to the embodiment 2 except that the conductive film 3 in this embodiment was constituted by only Pd with Pd acetate (II) monoethanolamine complex being set to 14 m mol/1 and platinum acetate (II) monoethanolamine complex being set to 0 m mol/1, sealing was then similarly carried out. Thereafter, when the activating process was performed as in the embodiment 2, a plurality of devices which were not sufficiently activated were produced, and the electron emission characteristic equal to that of the embodiment 2 was not necessarily obtained even in the device in which the device current If was increased by activation.

EMBODIMENT 3

When the NTSC signal was inputted to the image forming apparatus produced by the manufacturing method in the embodiment 2 as described above, an excellent television image was obtained.

Further, according to each of the foregoing embodiments, the electron emitting device in each embodiment can be easily formed with a very small power and, even when the sealing process is executed after the forming process and/or the activating process for forming the electron emitting section formed thereby, the subsequent application of a voltage to the electron emitting section can be effectively and sufficiently performed, thus enabling great reduction in loss on spoilage. In addition, since an electrical change in the conductive film 3 subjected to the sealing process is small, irregularity in each device during the electric process after sealing the plural devices and the actual driving is also decreased, thereby improving the uniformity of the electric source substrate and the image display apparatus.

The present invention can provide the electron emitting device and the electron source having the stable electron emitting characteristic.

Moreover, the present invention can provide the electron emitting device and the electron source having the stable electron emitting characteristic with respect to heat in particular.

In addition, the present invention can provide the image forming apparatus by which a change in image to be formed with time is reduced.

Further, the present invention can provide the electron emitting device, the electron source and the image forming apparatus with the electric power during the electric process in the manufacturing process being reduced as much as possible.

Furthermore, the present invention can provide a method for manufacturing the electron emitting device, the electron source and the image forming apparatus which are superior in the characteristic reproducibility.

What is claimed is:

1. An electron emitting device comprising a conductive film having an electron emitting section between a pair of device electrodes, wherein said conductive film consists of a plurality of transition metals in a solid solution.

2. An electron emitting device comprising a pair of conductive films which are respectively connected a pair of device electrodes between said pair of device electrodes and disposed with a first gap therebetween, wherein said pair of conductive films consist of a plurality of transition metals in a solid solution.

3. An electron emitting device according to claim 1 or 2, wherein said transition metals consist of Pd and Pt.

4. An electron emitting device according to claim 1 or 2, wherein said conductive film includes a carbon film.

5. An electron emitting device according to claim 2 comprising a carbon film so disposed as to form a second gap narrower than said first gap on said pair of conductive films and in said first gap.

6. An electron source comprising a plurality of electron emitting devices on a substrate, wherein said electron emitting device is as defined in any one of claims 1–4 or 5.

7. An electron source comprising a plurality of electron emitting devices matrix-wired on a substrate, wherein said electron emitting device is as defined in any one of claims 1–4 or 5.

8. An image forming apparatus comprising: an electron source; and an image forming member for forming an image by irradiation of an electron ray from said electron source, wherein said electron source is as defined in claim 6.

9. An image forming apparatus comprising: an electron source; and an image forming member for forming an image by irradiation of an electron ray from said electron source, wherein said electron source is as defined in claim 7.

* * * * *

UNITED STATES PATENT AND TRADEMARK OFFICE

CERTIFICATE OF CORRECTION

PATENT NO. : 6,693,375 B1
DATED : February 17, 2004
INVENTOR(S) : Tomoko Maruyama It is certified that error appears in the above-identified patent and that said Letters Patent is hereby corrected as shown below:

Column 8,
Line 22, “or an” should read -- on an --; and
Line 24, “3-electrically” should read -- 3 electrically --.

Column 9,
Line 13, “approximate” should read -- approximates --.

Column 10,
Line 63, “Regarding to” should read -- Regarding --.

Column 11,
Line 6, “very” should read -- much --;
Line 7, “FIG. 7,” should read -- FIG. 7; --; and
Line 41, “either the characteristic” should read -- either characteristic --.

Column 15,
Line 49, “know,” should read -- known, --.

Column 16,
Line 31, “At” should be deleted;
Line 32, “second,” should read -- Secondly, --; and
Line 62, “sianal” should read -- signal --.

Column 18,
Line 28, “(FIG. 3B.” should read -- (FIG. 3B). --.

Column 19,
Line 25, “is” should be deleted.

UNITED STATES PATENT AND TRADEMARK OFFICE

CERTIFICATE OF CORRECTION

PATENT NO. : 6,693,375 B1
DATED : February 17, 2004
INVENTOR(S) : Tomoko Maruyama It is certified that error appears in the above-identified patent and that said Letters Patent is hereby corrected as shown below:

Column 22,
Line 29, "connected" should read -- connected to --;
Line 44, "claims 1-4 or 5" should read -- claims 1, 2 or 5 --; and
Line 48, "1-4 or 5" should read -- 1, 2 or 5 --.

Signed and Sealed this

Twentieth Day of July, 2004

JON W. DUDAS
*Acting Director of the United States Patent and Trademark Office*